US010973305B2

(12) United States Patent
Plante

(10) Patent No.: US 10,973,305 B2
(45) Date of Patent: Apr. 13, 2021

(54) LOAD BEARING POSITIONING SYSTEM AND METHOD

(71) Applicant: Stephen M. Plante, Winter Park, FL (US)

(72) Inventor: Stephen M. Plante, Winter Park, FL (US)

( * ) Notice: Subject to any disclaimer, the term of this patent is extended or adjusted under 35 U.S.C. 154(b) by 130 days.

(21) Appl. No.: 14/469,939

(22) Filed: Aug. 27, 2014

(65) Prior Publication Data

US 2015/0108189 A1 Apr. 23, 2015

Related U.S. Application Data

(63) Continuation-in-part of application No. 14/057,156, filed on Oct. 18, 2013, now abandoned.

(51) Int. Cl.
*A45F 3/12* (2006.01)
*A45F 3/04* (2006.01)

(52) U.S. Cl.
CPC ..... *A45F 3/04* (2013.01); *A45F 3/047* (2013.01)

(58) Field of Classification Search
CPC ..... A45F 3/12; A45F 3/047; A45F 2003/001; A41D 27/26; A41D 13/0512; A63B 55/408; A63B 71/12
USPC ..... 224/255, 264
See application file for complete search history.

(56) References Cited

U.S. PATENT DOCUMENTS 1,340,077 A * 5/1920 Orr ..... 224/640
2,487,423 A * 11/1949 Cast ..... A41D 27/26 224/264
5,203,482 A * 4/1993 Puff ..... 224/257
5,269,449 A * 12/1993 Sattler ..... 224/258
5,319,806 A * 6/1994 Hermann ..... A41D 13/0512 2/267
5,816,460 A * 10/1998 Cook ..... A45C 1/04 224/260
8,578,513 B2 11/2013 Carlson et al.
2002/0108979 A1* 8/2002 Finkelstein ..... 224/264
2004/0089687 A1 5/2004 Ammerman
2006/0289575 A1* 12/2006 Chou ..... A45F 5/00 224/264
2008/0156839 A1* 7/2008 Betcher ..... A45F 3/14 224/630
2012/0168474 A1* 7/2012 Bevier et al. ..... 224/257
2013/0153614 A1* 6/2013 Wetzsteon ..... A45F 3/12 224/264

OTHER PUBLICATIONS

See attached IDS_PDF1.
See attached IDS_PDF2.
See attachment NPL_hockey.
See attachment NPL_giroud.

* cited by examiner

*Primary Examiner* — Adam J Waggenspack
(74) *Attorney, Agent, or Firm* — Allen Dyer Doppelt & Gilchrist, PA

(57) ABSTRACT

A system may include an acromion-socket constructed out of multiple components that are shaped to engage a user's acromion-portion. The system may also include a strap positioned away from the user's neck by the acromion-socket to connect a load to the user.

4 Claims, 15 Drawing Sheets

LOAD BEARING POSITIONING SYSTEM AND METHOD

CROSS-REFERENCE TO RELATED APPLICATIONS

This application is a continuation-in-part of co-pending U.S. patent application Ser. No. 14/057,156, filed 18 Oct. 2013, and is incorporated herein by reference. The present application and the priority application identified above include identical inventorship and ownership.

BACKGROUND

The disclosure relates to the field of load bearing systems.

Generally and in humans, an acromion comprises an outer end of the scapula. A humerus comprises the long bone in the arm extending from the shoulder to the elbow. A clavicle comprises a bone that extends from the sternum to the acromion.

SUMMARY

In one embodiment, a system may include an acromion-socket constructed out of multiple components that are shaped to engage a user's acromion-portion. The system may also include a strap positioned away from the user's neck by the acromion-socket to connect a load to the user.

The acromion-socket may be shaped to also engage a user's upper humerus that is closest to the user's acromion-portion, and the multiple components includes a weight bearing material and at least one of fabric, thread, adhesive, fastener, deformable material, hard member, thermoformed material, webbing, and flexible member. The acromion-socket may be removable from the strap, can be added to the strap, can be positioned anywhere along the strap, positioned by strap tension, and/or integral to the strap.

The load may be carried in front, back, and/or side of the user. The strap crosses a vertical line defined by the user's spinal cord and/or does not cross a vertical line defined by the user's spinal cord.

The acromion-socket shape may be fixed prior to any load bearing. The acromion-socket may be pre-formed by a manufacturer of the acromion-socket to aid in engaging the user's acromion-portion, and the strap may be narrower than the acromion-socket to provide the user reduced heat buildup, increased mobility, reduced chances of snagging, and/or greater ease of use.

The acromion-socket pre-forming may be achieved by material cut pattern, fastening pattern, fabrication process, panel shaping, thermo-forming, and/or material selection. The acromion-socket may maintain the load's weight on the user's acromion-portion during use of the acromion-socket by positioning the acromion-socket on the user's acromion-portion through the cupping of the user's acromion-portion instead of permitting the acromion-socket to slide away from the user's acromion-portion and towards the user's neck.

The acromion-socket may transfer a majority of the load's weight to the user's acromion-portion. The user's acromion-portion may include a portion of the user's deltoid muscle.

Another aspect is a method, which may include engaging a user's acromion-portion with a shaped acromion-socket. The method may also include positioning a load away from the user's neck via the acromion-socket.

The method may further include making the acromion-socket monolithic and/or made of multiple components. The method may additionally include making the acromion-socket removable from a strap, can be added to a strap, can be positioned anywhere along a strap, positioned by strap tension, shaping the acromion-socket by tension, and/or integral to a strap.

The method may also include carrying the load by front, back, and/or side of the user. The method may further include fixing the shape of the acromion-socket prior to any load bearing.

The method may additionally include pre-forming the shape of the acromion-socket by a manufacturer of the acromion-socket to aid in engaging the user's acromion-portion. The method may also include achieving the acromion-socket pre-forming by material cut pattern, fastening pattern, fabrication process, panel shaping, thermo-forming, and/or material selection. The method may further comprise including a portion of the user's deltoid muscle in the user's acromion-portion.

In another embodiment, the system may include an acromion-socket that is shaped to engage a user's acromion-portion, the acromion-socket is designed to carry a load greater than five pounds for over an hour without damaging the acromion-socket, and/or the acromion-socket positions a load away from the user's neck.

In one embodiment, the system includes an acromion-socket to receive a user's acromion-portion. The system may also include a strap positioned by the acromion-socket where the strap connects a load to the user.

The acromion-socket may be shaped to also engage a user's humerus that is closest to the user's acromion-portion. The acromion-socket may be removable from the strap, can be positioned anywhere along the strap, and/or integral to the strap.

The acromion-socket's greatest width is larger than the strap's greatest width. The strap crosses a vertical line defined by the user's spinal cord and/or does not cross a vertical line defined by the user's spinal cord.

The acromion-socket comprises a deformable material that aids in engaging the user's acromion-portion and/or a hard member that aids in engaging the user's acromion-portion. The acromion-socket is pre-formed to aid in receiving the user's acromion-portion. The acromion-socket pre-forming is achieved by material cut pattern, fastening pattern, fabrication process, and/or material selection.

The acromion-socket maintains the load's weight on the user's acromion-portion during use of the acromion-socket by positioning the acromion-socket on the user's acromion-portion through the cupping of the user's acromion-portion instead of permitting the acromion-socket to slide away from the user's acromion-portion and towards the user's clavicle closest to the user's acromion-portion. The acromion-socket transfers a majority of the load's weight to the user's acromion-portion.

Another aspect is a method, which may include receiving a user's acromion-portion in an acromion-socket. The method may also include positioning a strap by the acromion-socket where the strap connects a load to the user.

The method may further include shaping the acromion-socket to also engage a user's humerus that is closest to the user's acromion-portion. The method may additionally include making the acromion-socket removable from the strap, positioned anywhere along the strap, and/or integral to the strap.

The method may also include making the acromion-socket's greatest width larger than the strap's greatest width. The method may further include making the strap cross a vertical line defined by the user's spinal cord and/or not cross a vertical line defined by the user's spinal cord.

The method may additionally include engaging the user's acromion-portion via a deformable material and/or a hard member that aids in engaging the user's acromion-portion. The method may also include pre-forming the acromion-socket to aid in receiving the user's acromion-portion. The method may further include achieving the pre-forming of the acromion-socket by material cut pattern, fastening pattern, fabrication process, and/or material selection.

The method may additionally include maintaining the load's weight on the user's acromion-portion during use of the acromion-socket by positioning the acromion-socket on the user's acromion-portion through the cupping of the user's acromion-portion instead of permitting the acromion-socket to slide away from the user's acromion-portion and towards the user's clavicle closest to the user's acromion-portion. The method may also include transferring via the acromion-socket a majority of the load's weight to the user's acromion-portion.

In an alternative embodiment, the system may include an acromion-socket to receive a user's acromion-portion where the acromion-socket's greatest width while being used is larger than the strap's greatest width while being used, and the acromion-socket is pre-formed to aid in receiving the user's acromion-portion. The system may also include a strap positioned by the acromion-socket where the strap connects a load to the user.

DETAILED DESCRIPTION

Embodiments will now be described more fully hereinafter with reference to the accompanying drawings, in which preferred embodiments are shown. Like numbers refer to like elements throughout.

Figure 1:
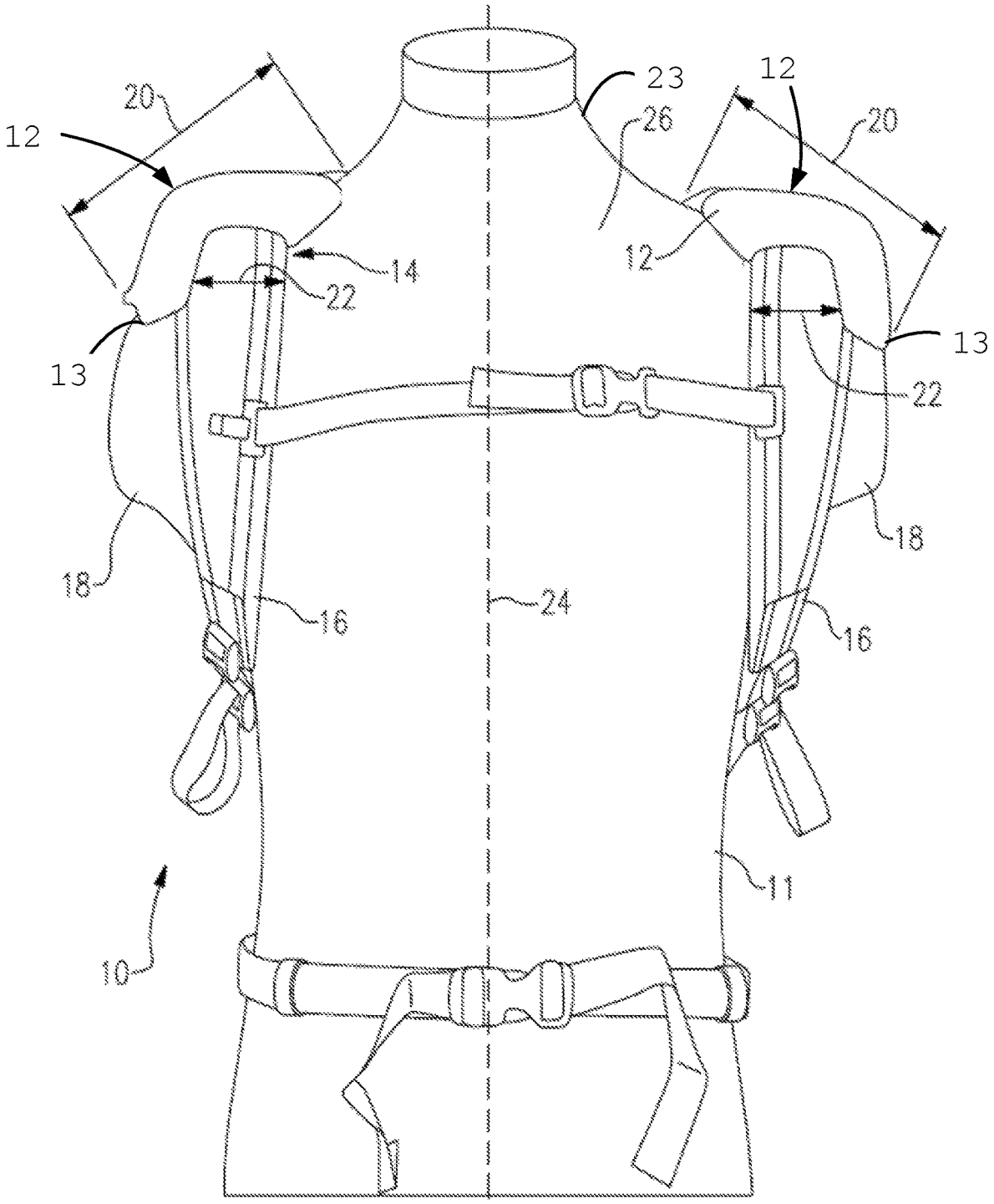
FIG. 1 is a front-view illustration of a load bearing system in accordance with various embodiments.
Figure 2:
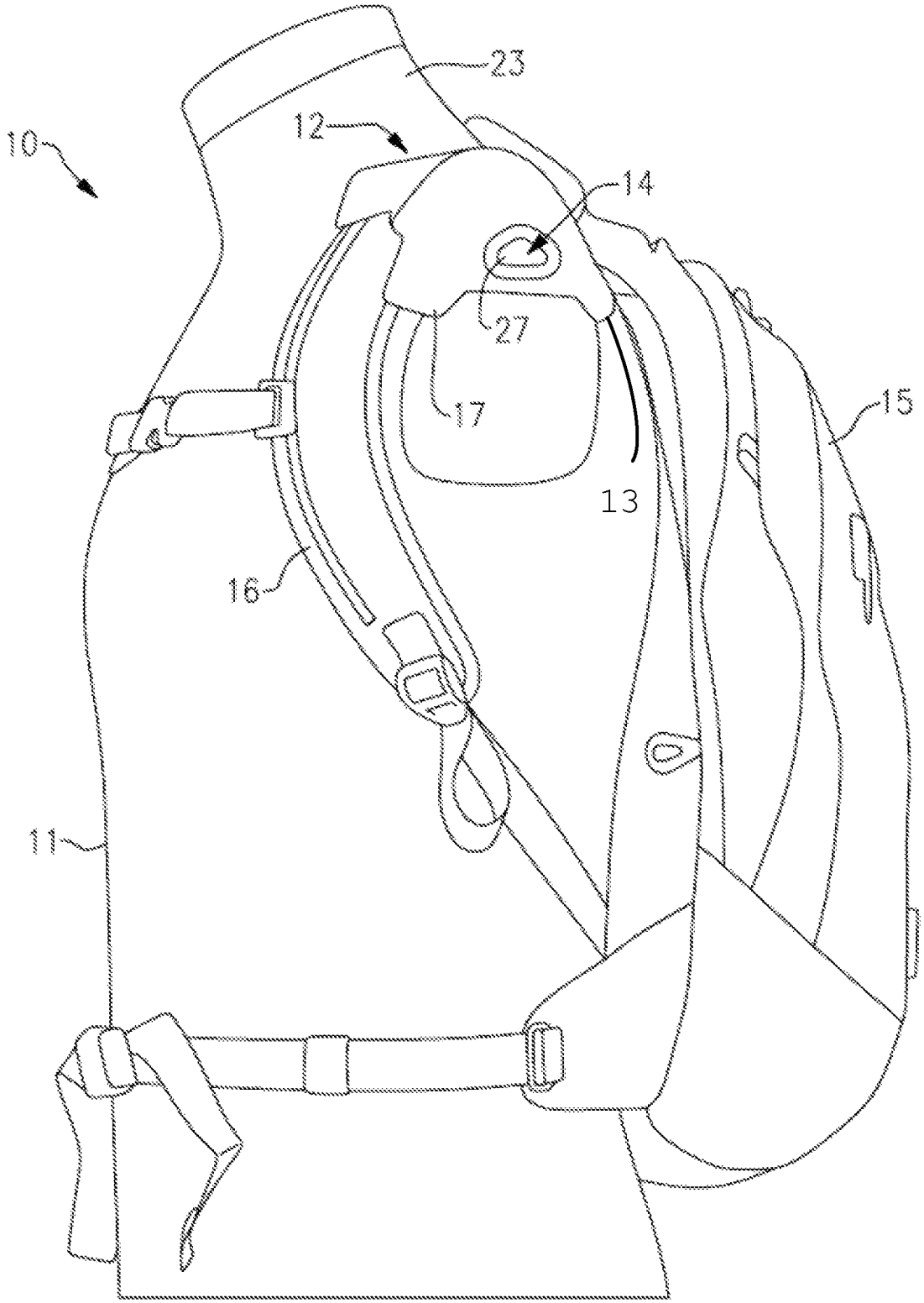
FIG. 2 is a side-view illustration of the load bearing system of FIG. 1.
Figure 3:
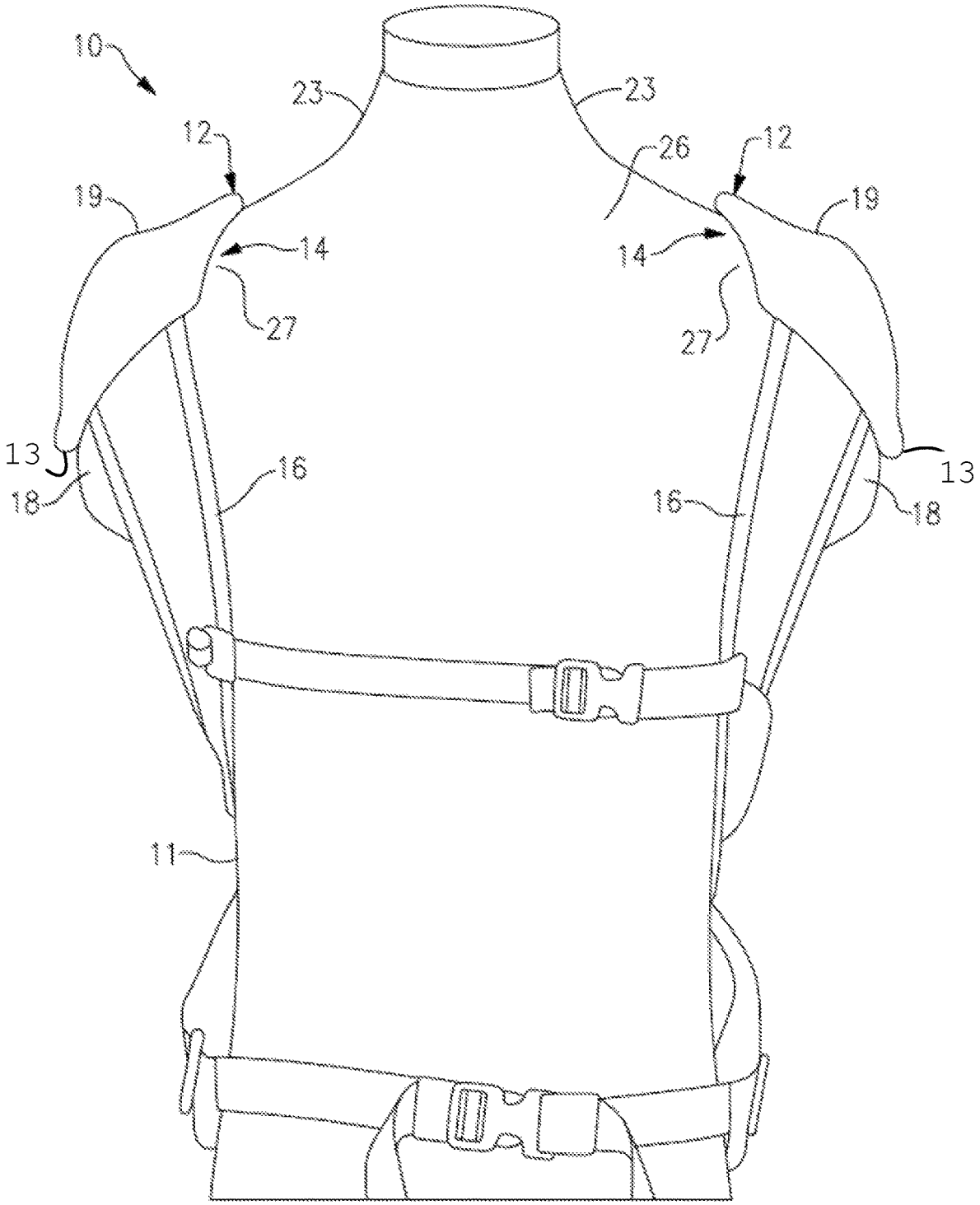
FIG. 3 is a front-view illustration of an alternative embodiment of the load bearing system of FIG. 1.
Figure 4:
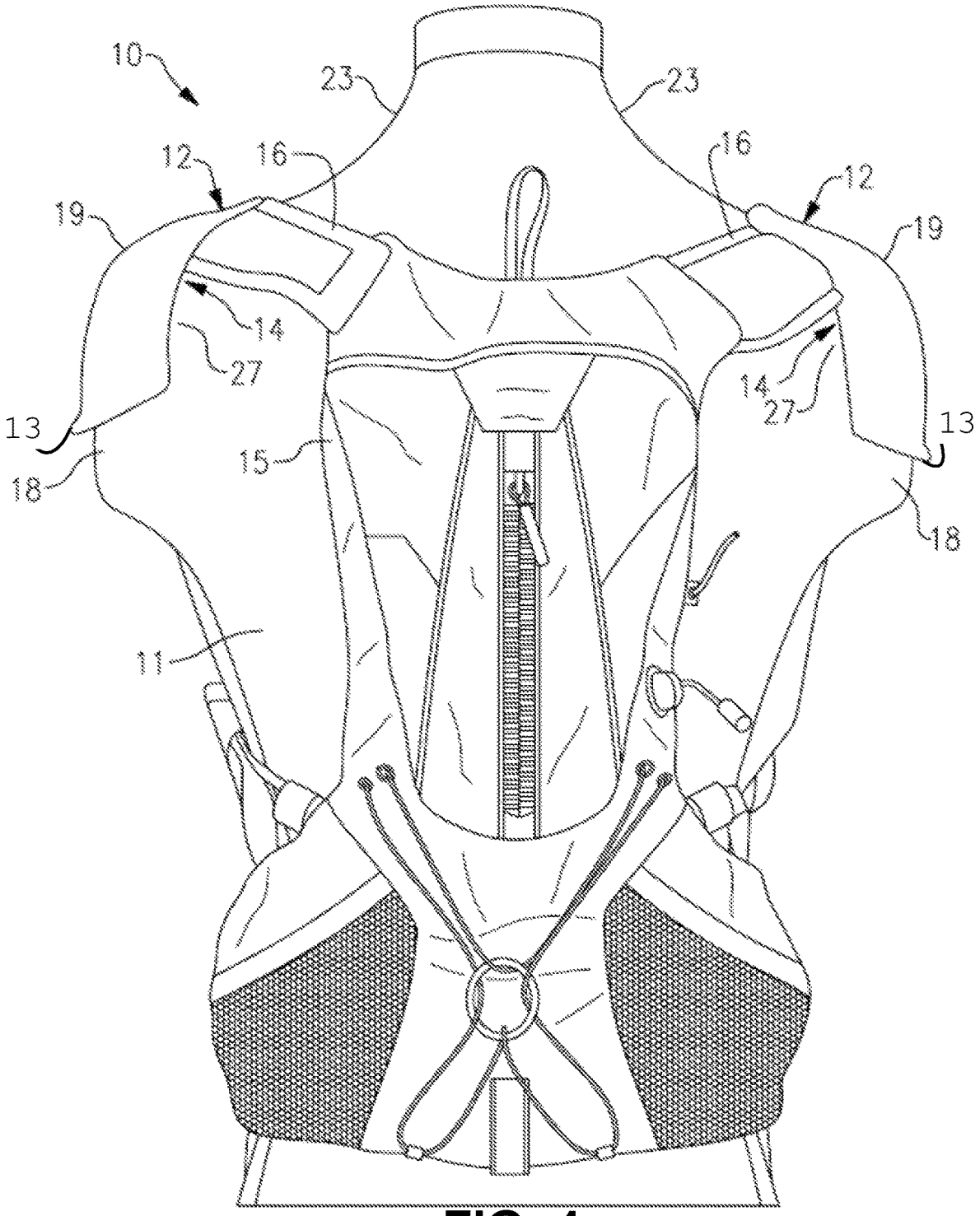
FIG. 4 is a rear-view illustration of the load bearing system of FIG. 3.

With reference now to FIG. 1, a load bearing system 10 is initially described. In one embodiment, the system 10 includes an acromion-socket 12 to receive a user's 11 acromion-portion 14. In one embodiment, the acromion-socket 12 includes an edge 13 furthest from the neck 23 designed to carry a portion of a load 15. In one embodiment, the acromion-portion 14 comprises the user's 11 acromion, muscles, ligaments, skin, and/or the like. In another embodiment, the acromion-portion 14 comprises the user's 11 acromion, humerus, muscles, ligaments, skin, clothing, and/or the like.

In one embodiment, the acromion-portion 14 comprises at least one of the user's 11 muscles, ligaments, skin, clothing, and/or the like, but excludes the user's acromion. In another embodiment, the acromion-portion 14 comprises the user's 11 humerus, muscles, ligaments, skin, clothing, and/or the like, but excludes the user's acromion. In another embodiment, the acromion-socket 12 includes openings. For example, the openings can provide ventilation, reduced weight, and/or the like.

The system 10 also includes a strap 16 positioned by the acromion-socket 12 where the strap connects a load 15 to the user 11. For example, the load 15 comprises a daypack, messenger bag, backpack, heavy item, bulky article, golf clubs, equipment such as lawn maintenance equipment, an infant carrier (front, back, or side), and/or the like. In one embodiment, the load 15 excludes clothing, garments, and/or the like. In another embodiment, the system 10 excludes the positioning of a user's 11 clothing, garments, and/or the like. The strap 16 can include multiple attachment points to the acromion-socket 12 and/or the load, for instance. In another embodiment, the strap 16 includes multiple straps that connect to the acromion-socket 12 and/or the load 15. In another embodiment, the strap 16 includes an outrigger (not shown) that passes under the user's 11 arm.

In one embodiment, the acromion-socket 12 is shaped to also engage a user's 11 upper-humerus 18 that is closest to the user's acromion-portion 14. In other words, the acromion-socket 12 receives, e.g. cups, the user's 11 acromion-portion 14 as well as the user's upper-humerus 18. In another embodiment, the acromion-socket 12 is removable from the strap 16, can be positioned anywhere along the strap, and/or integral to the strap. For example, the upper-humerus 18 includes the humeral greater tubercle, humeral lesser tubercle, humeral head, surgical neck, deltoid tuberosity, and/or the like.

In one embodiment, the acromion-socket's 12 greatest width 20 is larger than the strap's 16 greatest width 22. For example, the acromion-socket's 12 greatest width while being used by the user 11 is larger than the strap's 16 greatest width at that same point in time.

In one embodiment, the strap 16 crosses a vertical line 24 defined by the user's 11 spinal cord and/or does not cross a vertical line defined by the user's spinal cord. In other words, the strap 16 stays on the side of the acromion-socket 12 and/or crosses over the spinal cord line 24 to the user's 11 other side.

In one embodiment, the acromion-socket 12 comprises a deformable material 19 that aids in engaging the user's 11 acromion-portion 14 and/or a hard member 17 that aids in engaging the user's acromion-portion. For example, the deformable material 19 comprises foam, elastic material, padding, and/or the like, and the deformable material conforms to the user's 11 acromion-portion 14 during use of the acromion-socket 12. In another embodiment, the hard member 17 comprises a plastic cup and/or the like that covers the acromion-socket's 12 side, e.g. top-side, that does not engage the user 11, for instance. In another embodiment, the hard member 17 comprises ribs, plates, and/or the like.

In one embodiment, the acromion-socket 12 is pre-formed to aid in receiving the user's 11 acromion-portion 14. For example, the acromion-socket 12 is sized and/or shaped to cup a user's 11 acromion-portion 14. The acromion-socket's 12 pre-forming is achieved by material cut pattern, fastening pattern, fabrication process, and/or material selection.

The material cut pattern aids in pre-forming the acromion-socket 12 when the panels are joined together, e.g. sewing, bonding, and/or the like, which have curved seams, which results in panel-shaping, for instance. Once the panels are together, they assume a predetermined acromion-socket 12 profile that includes a cavity to receive the user's 11 acromion-portion 14. The fastening pattern aids in pre-forming the acromion-socket 12 when the fasteners, e.g. strap and buckle, hook and loop combinations, and/or the like, are adjusted to provide the pre-formed shape, for example. The fabrication process aids in pre-forming the acromion-socket 12 when an elastic panel is joined to a non-elastic panel, e.g. alternating pattern, to provide a preload and/or post-load shaping to the acromion-socket 12, for instance. The material selection aids in pre-forming the acromion-socket 12 when a wire, hard member 17, panel, and/or the like provide structure to the acromion-socket 12.

In another embodiment, some degree of rotary motion is possible for the user's 11 acromion-portion 14 within the acromion-socket 12. In other words, the user's 11 acromion-portion 14 comprises a ball-like part, e.g. acromion, humerus, muscles, ligaments, skin, clothing, and/or the like, that fits into a ball-like socket, e.g. the acromion-socket 12, and such allows the ball-like part some free movement within the ball-like socket. In another embodiment, the rotary motion is possible for the user's 11 acromion-portion 14 with the acromion-socket 12 due to swivels, flexible members, and/or the like linking the acromion-socket to the strap 16.

In one embodiment, the acromion-socket 12 maintains the load's 15 weight on the user's 11 acromion-portion 14 during use of the acromion-socket by positioning the acromion-socket on the user's acromion-portion through the cupping of the user's acromion-portion instead of permitting the acromion-socket to slide away from the user's acromion-portion and towards the user's clavicle 26 closest to the user's acromion-portion. The acromion-socket 12 transfers a majority of the load's weight to the user's 11 acromion-portion 14.

Figure 5:
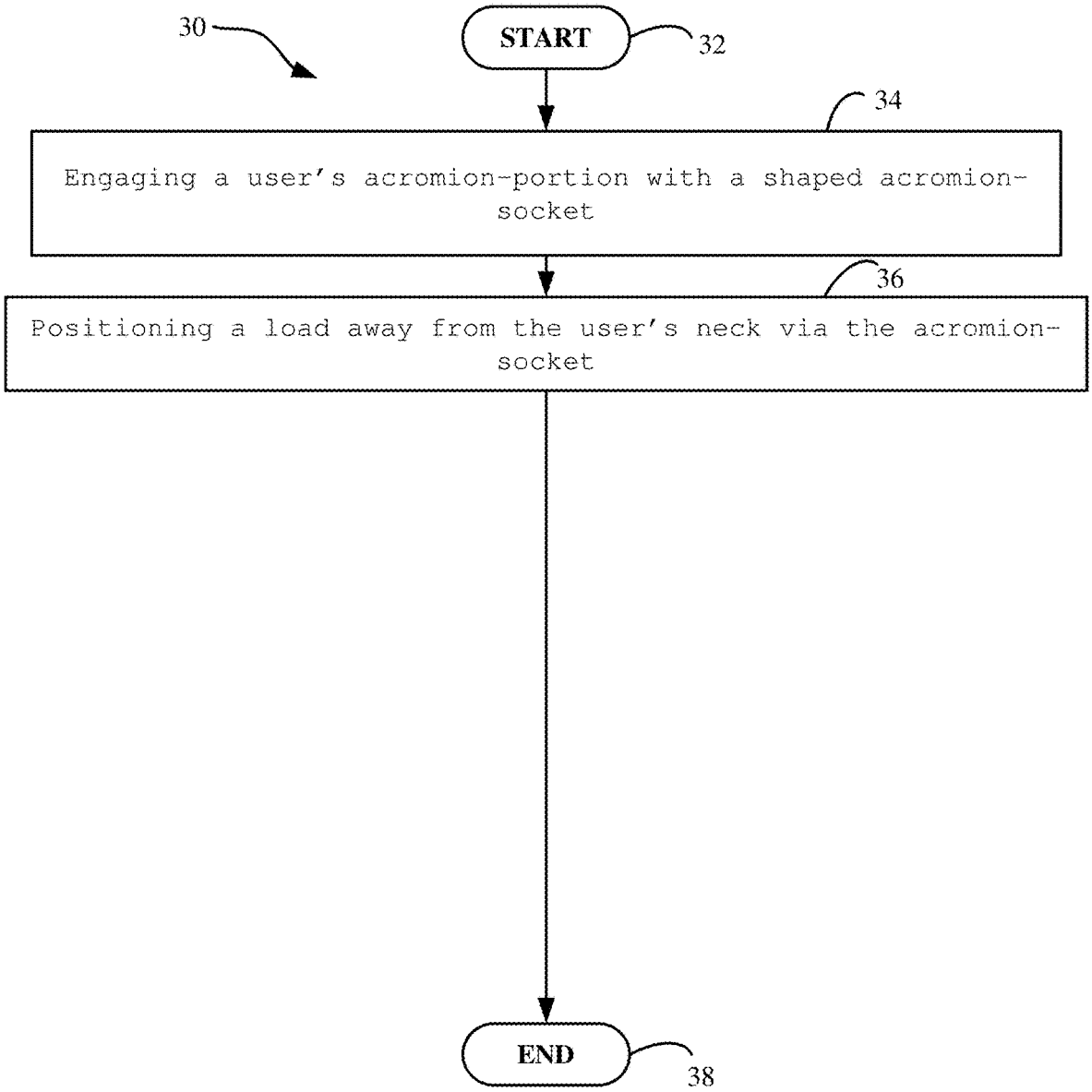
FIG. 5 is a flowchart illustrating method aspects according to various embodiments.

Another aspect is a method, which is now described with reference to flowchart 30 of FIG. 5. The method begins at Block 32 and may include engaging a user's acromion-portion with a shaped acromion-socket at Block 34. The method may also include positioning a load away from the user's neck via the acromion-socket at Block 36. The method ends at Block 38.

Figure 6:
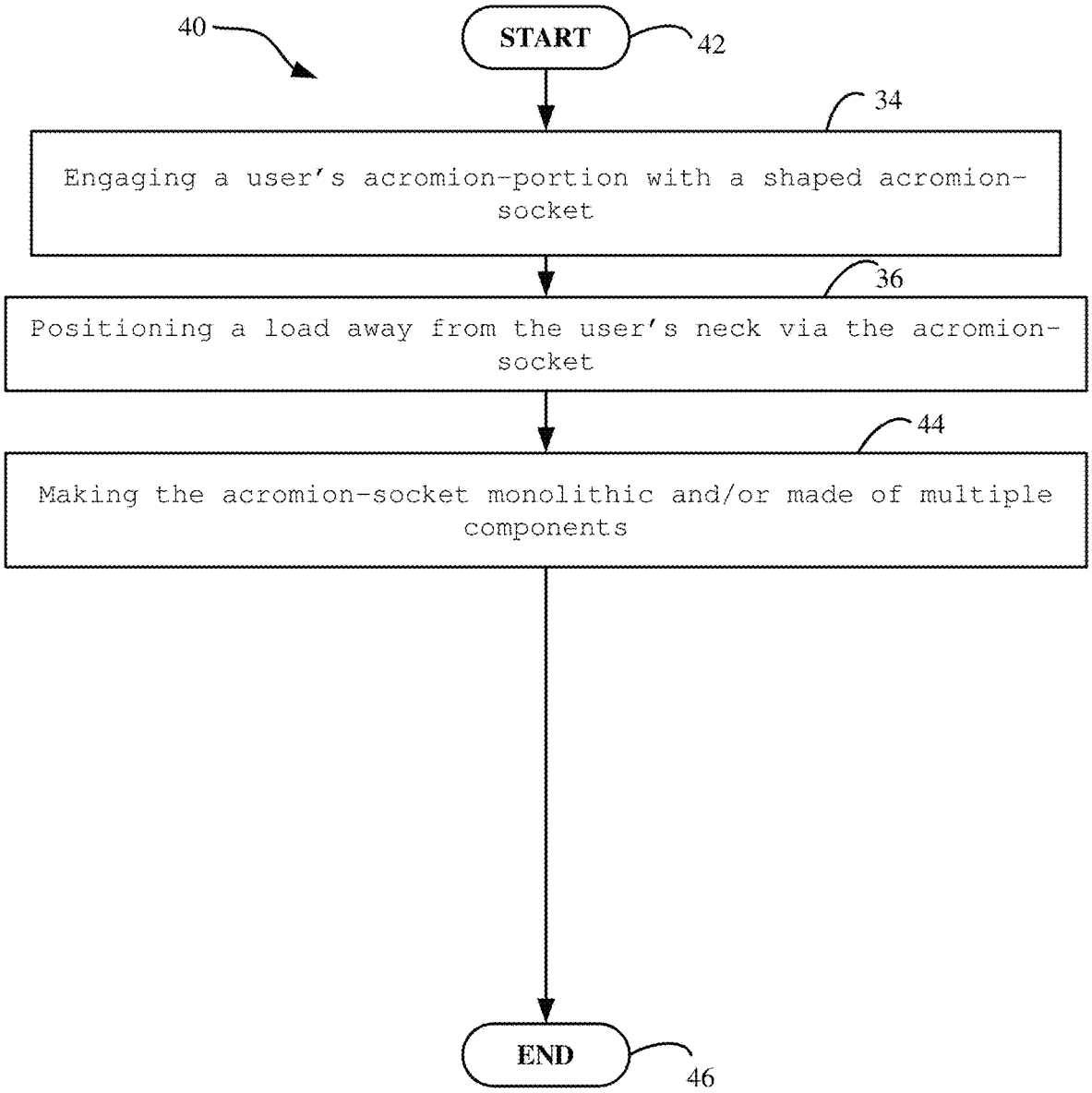
FIG. 6 is a flowchart illustrating method aspects according to the method of FIG. 5.

In another method embodiment, which is now described with reference to flowchart 40 of FIG. 6, the method begins at Block 42. The method may include the steps of FIG. 5 at Blocks 34 and 36. The method may additionally include making the acromion-socket monolithic and/or made of multiple components at Block 44. The method ends at Block 46.

Figure 7:
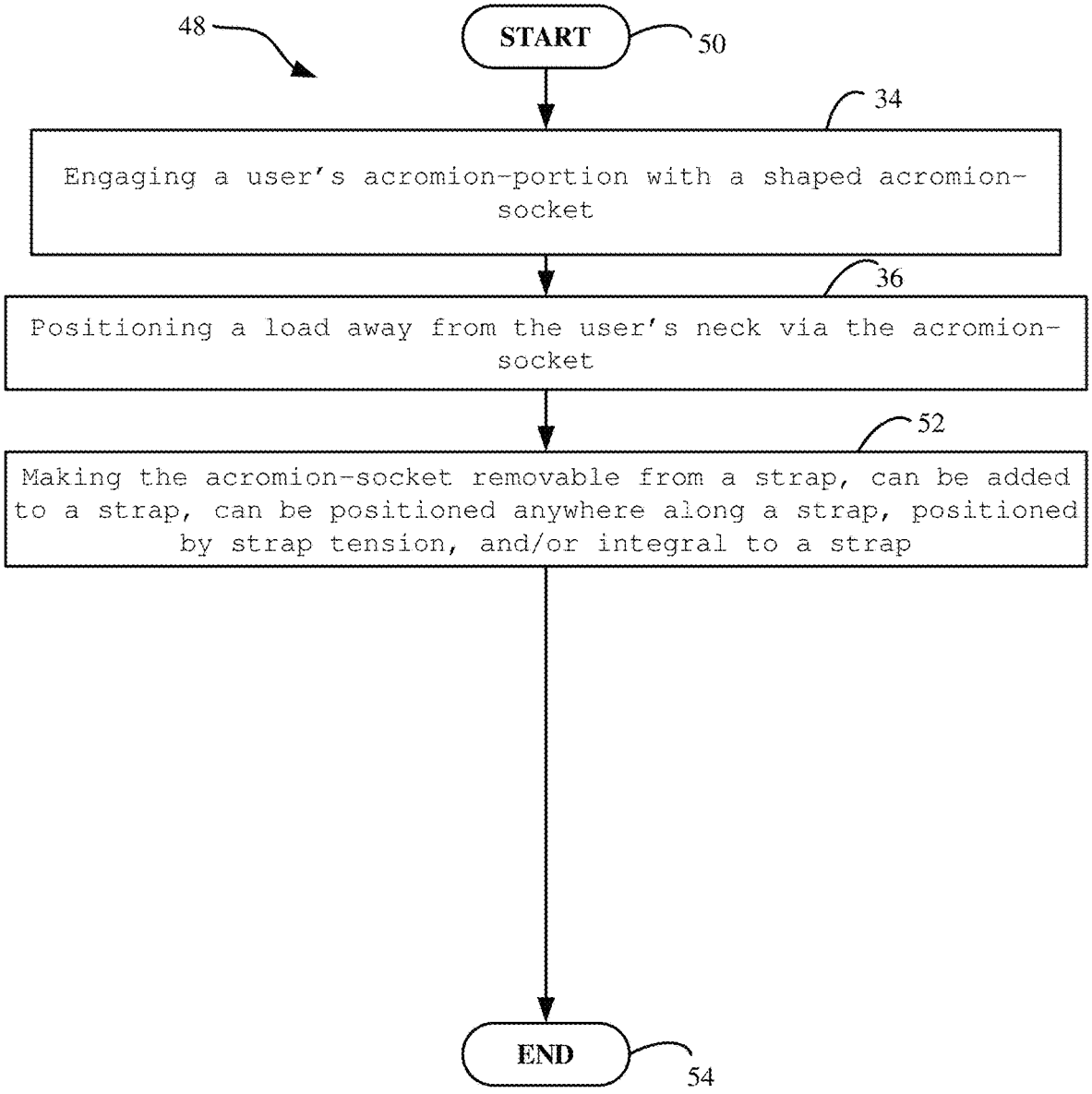
FIG. 7 is a flowchart illustrating method aspects according to the method of FIG. 5.

In another method embodiment, which is now described with reference to flowchart 48 of FIG. 7, the method begins at Block 50. The method may include the steps of FIG. 5 at Blocks 34 and 36. The method may additionally include making the acromion-socket removable from a strap, can be added to a strap, can be positioned anywhere along a strap, positioned by strap tension, and/or integral to a strap at Block 52. The method ends at Block 54.

Figure 8:
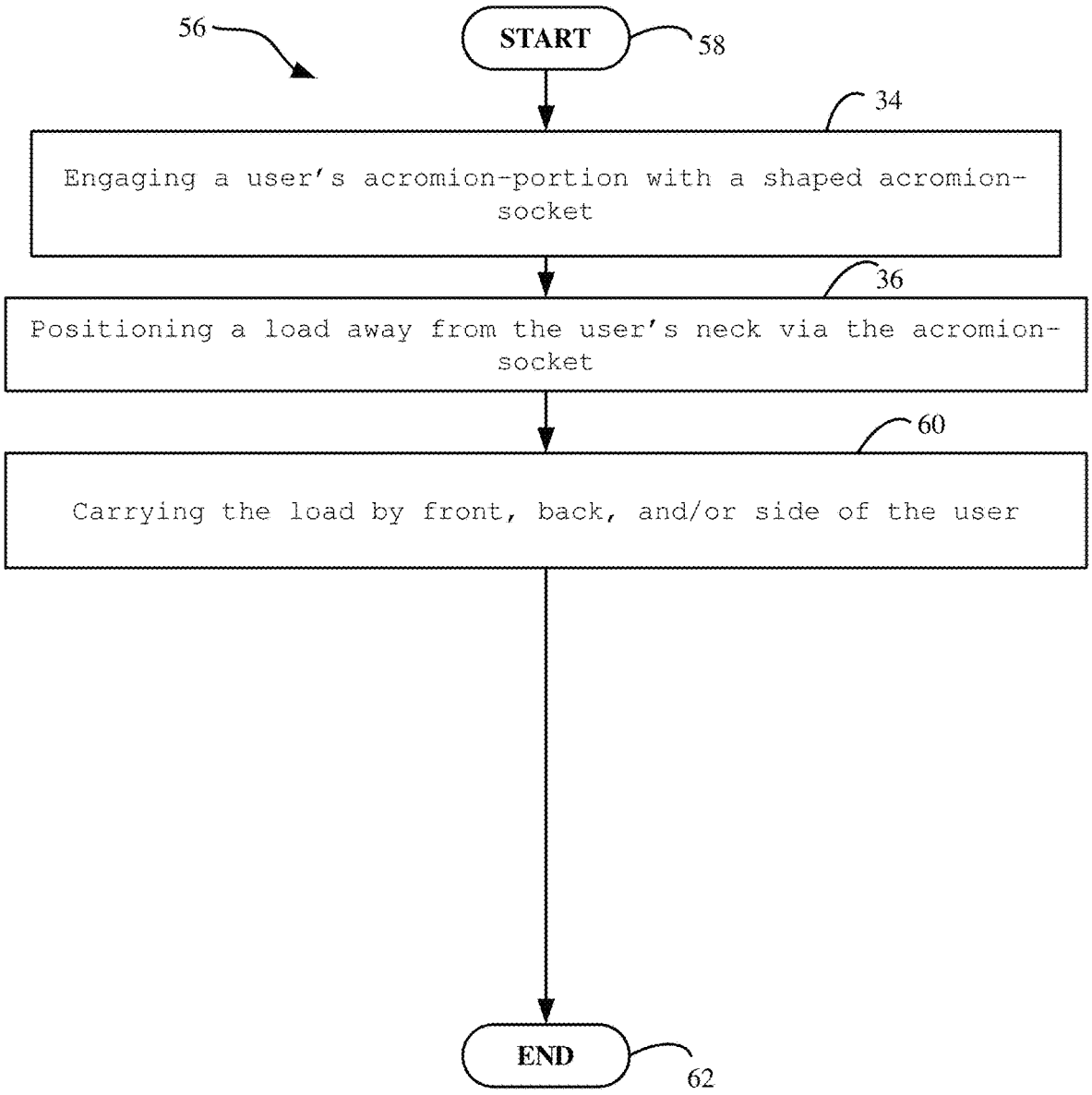
FIG. 8 is a flowchart illustrating method aspects according to the method of FIG. 5.

In another method embodiment, which is now described with reference to flowchart 56 of FIG. 8, the method begins at Block 58. The method may include the steps of FIG. 5 at Blocks 34 and 36. The method may additionally include carrying the load by front, back, and/or side of the user at Block 60. The method ends at Block 62.

Figure 9:
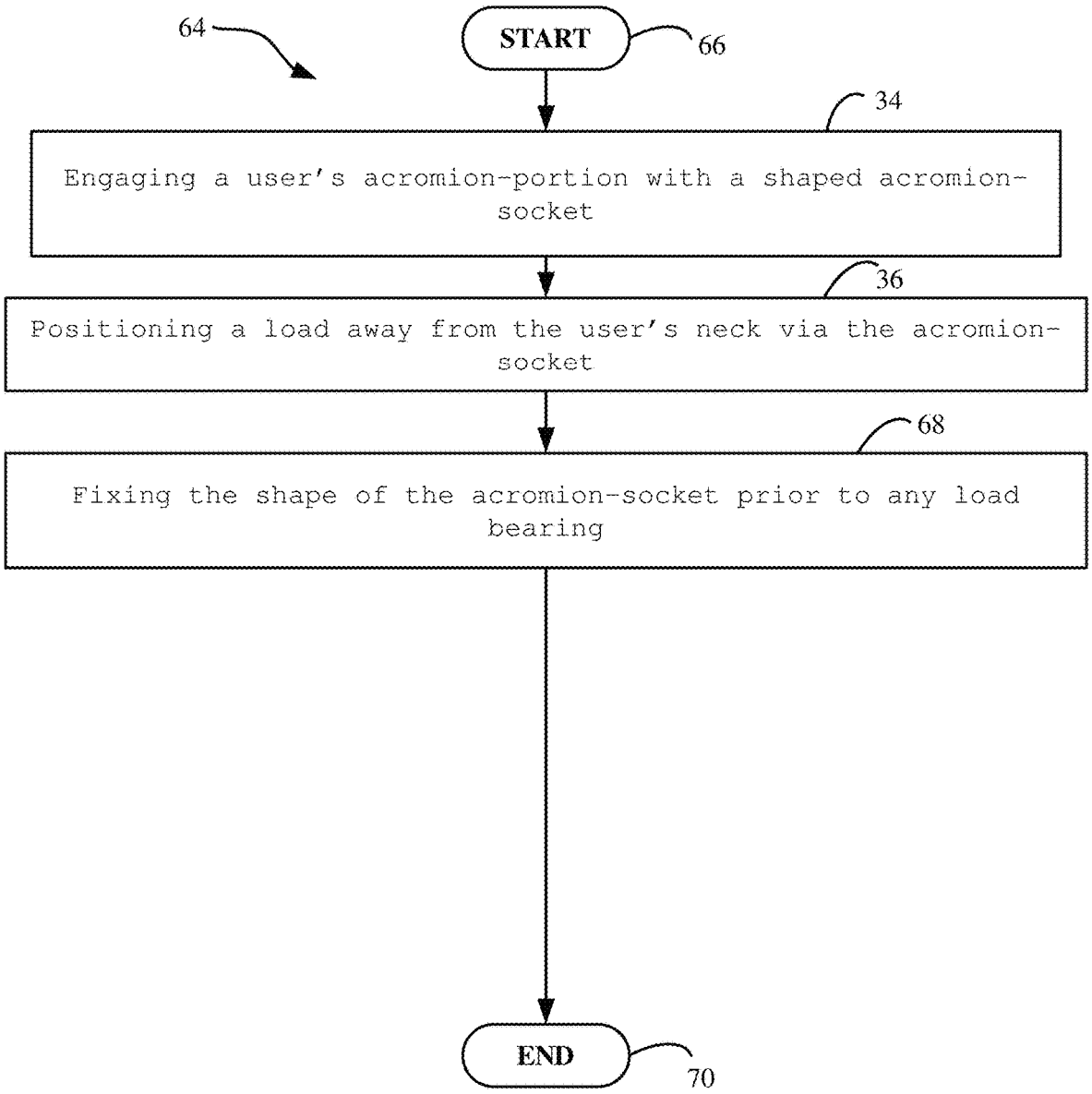
FIG. 9 is a flowchart illustrating method aspects according to the method of FIG. 5.

In another method embodiment, which is now described with reference to flowchart 64 of FIG. 9, the method begins at Block 66. The method may include the steps of FIG. 5 at Blocks 34 and 36. The method may additionally include fixing the shape of the acromion-socket prior to any load bearing at Block 68. The method ends at Block 70.

Figure 10:
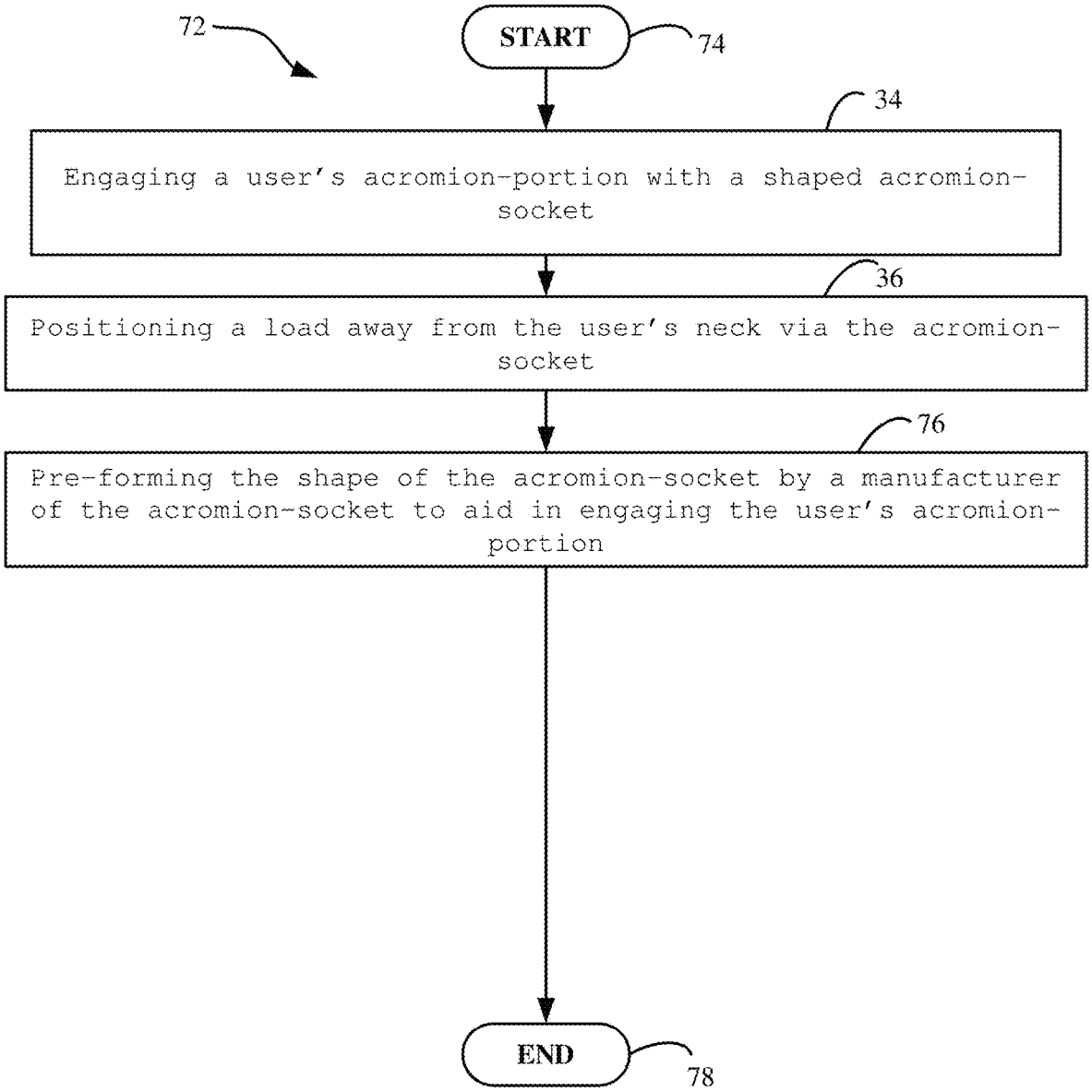
FIG. 10 is a flowchart illustrating method aspects according to the method of FIG. 5.

In another method embodiment, which is now described with reference to flowchart 72 of FIG. 10, the method begins at Block 74. The method may include the steps of FIG. 5 at Blocks 34 and 36. The method may additionally include pre-forming the shape of the acromion-socket by a manufacturer of the acromion-socket to aid in engaging the user's acromion-portion at Block 76. The method ends at Block 78.

Figure 11:
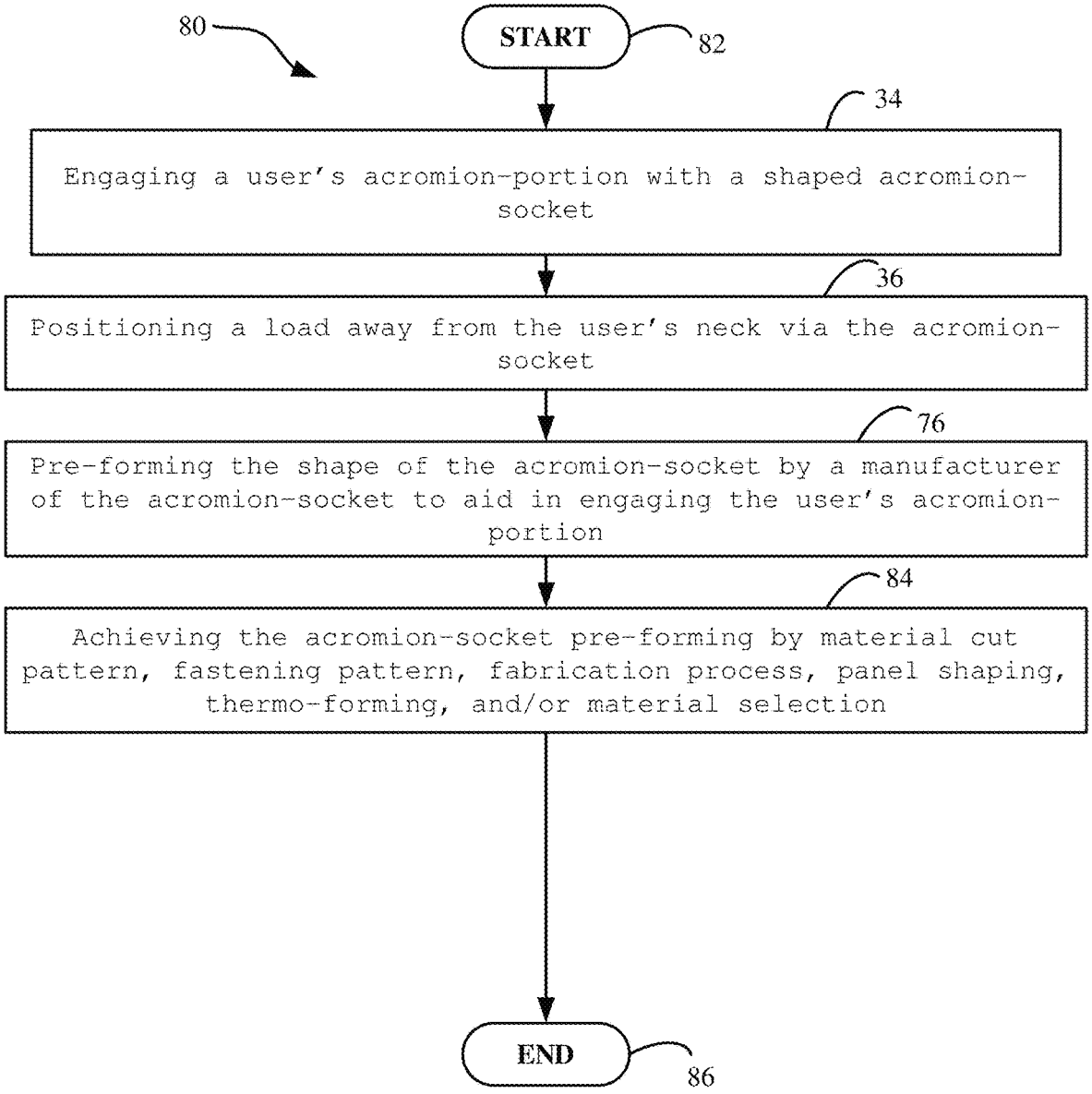
FIG. 11 is a flowchart illustrating method aspects according to the method of FIG. 10.

In another method embodiment, which is now described with reference to flowchart 80 of FIG. 11, the method begins at Block 82. The method may include the steps of FIG. 10 at Blocks 34, 36, and 76. The method may additionally include achieving the acromion-socket pre-forming by material cut pattern, fastening pattern, fabrication process, panel shaping, thermo-forming, and/or material selection at Block 84. The method ends at Block 86.

Figure 12:
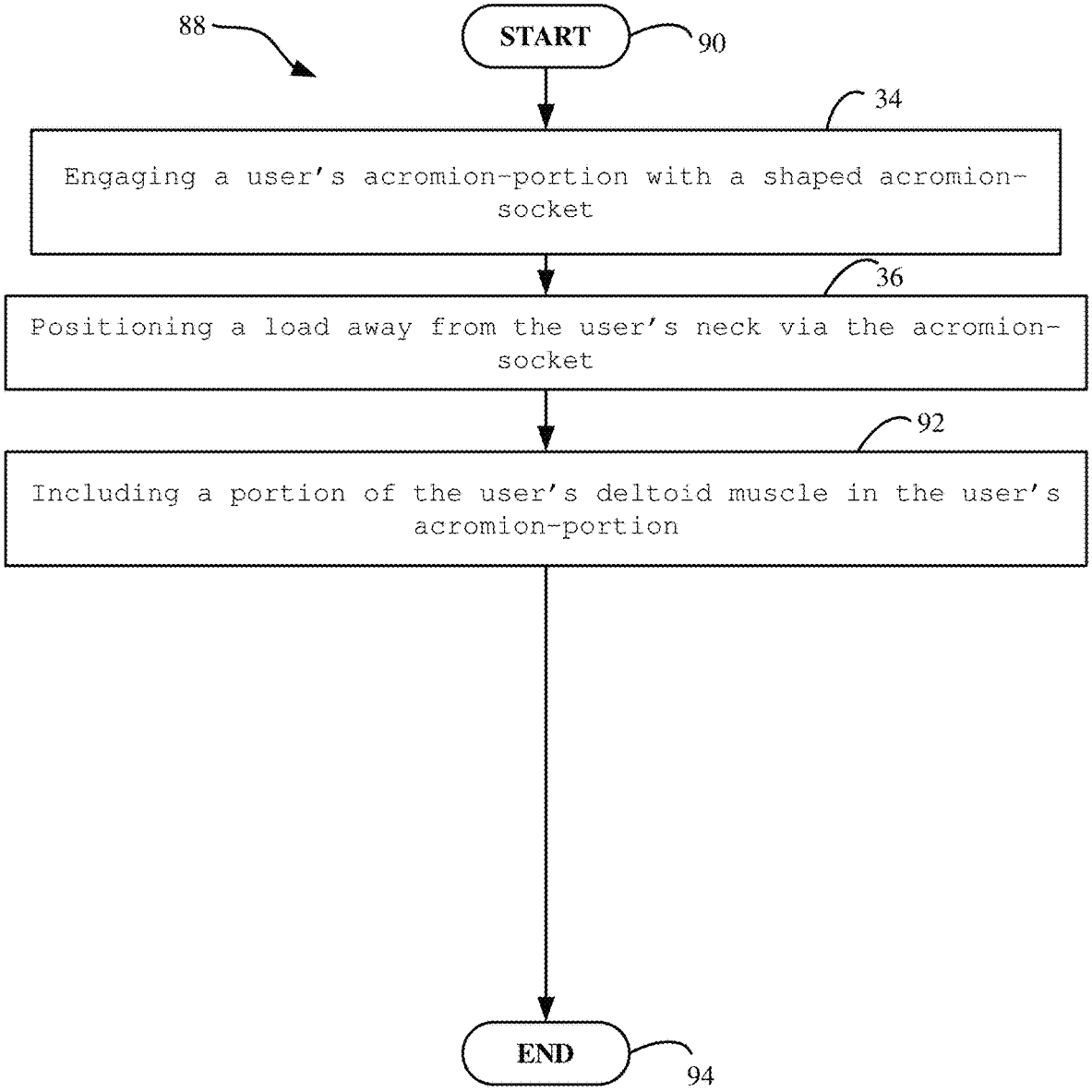
FIG. 12 is a flowchart illustrating method aspects according to the method of FIG. 5.

In another method embodiment, which is now described with reference to flowchart 88 of FIG. 12, the method begins at Block 90. The method may include the steps of FIG. 5 at Blocks 34 and 36. The method may additionally comprise including a portion of the user's deltoid muscle in the user's acromion-portion at Block 92. The method ends at Block 94.

Figure 13:
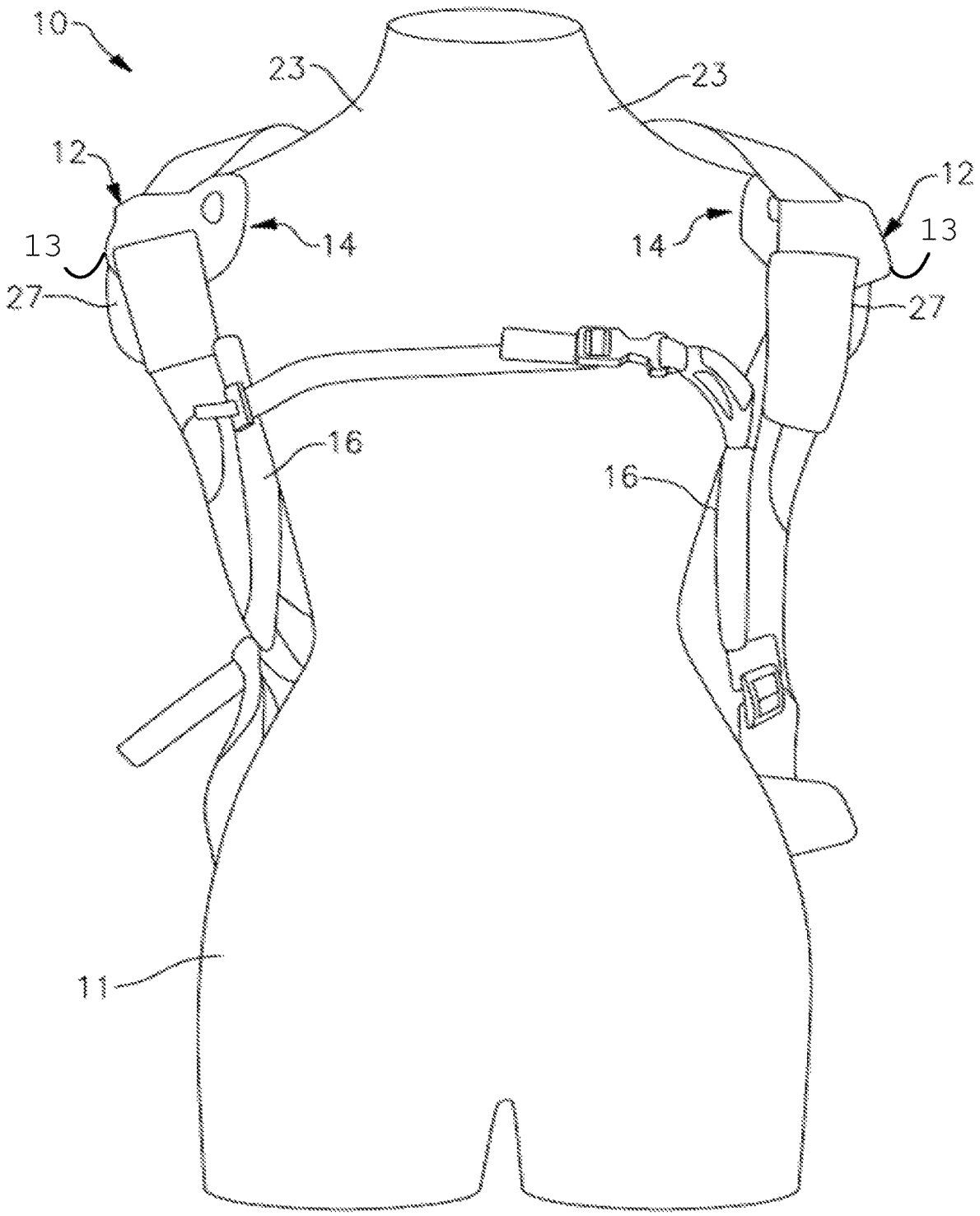
FIG. 13 is a front-view illustration of a load bearing system in accordance with another embodiment.
Figure 14:
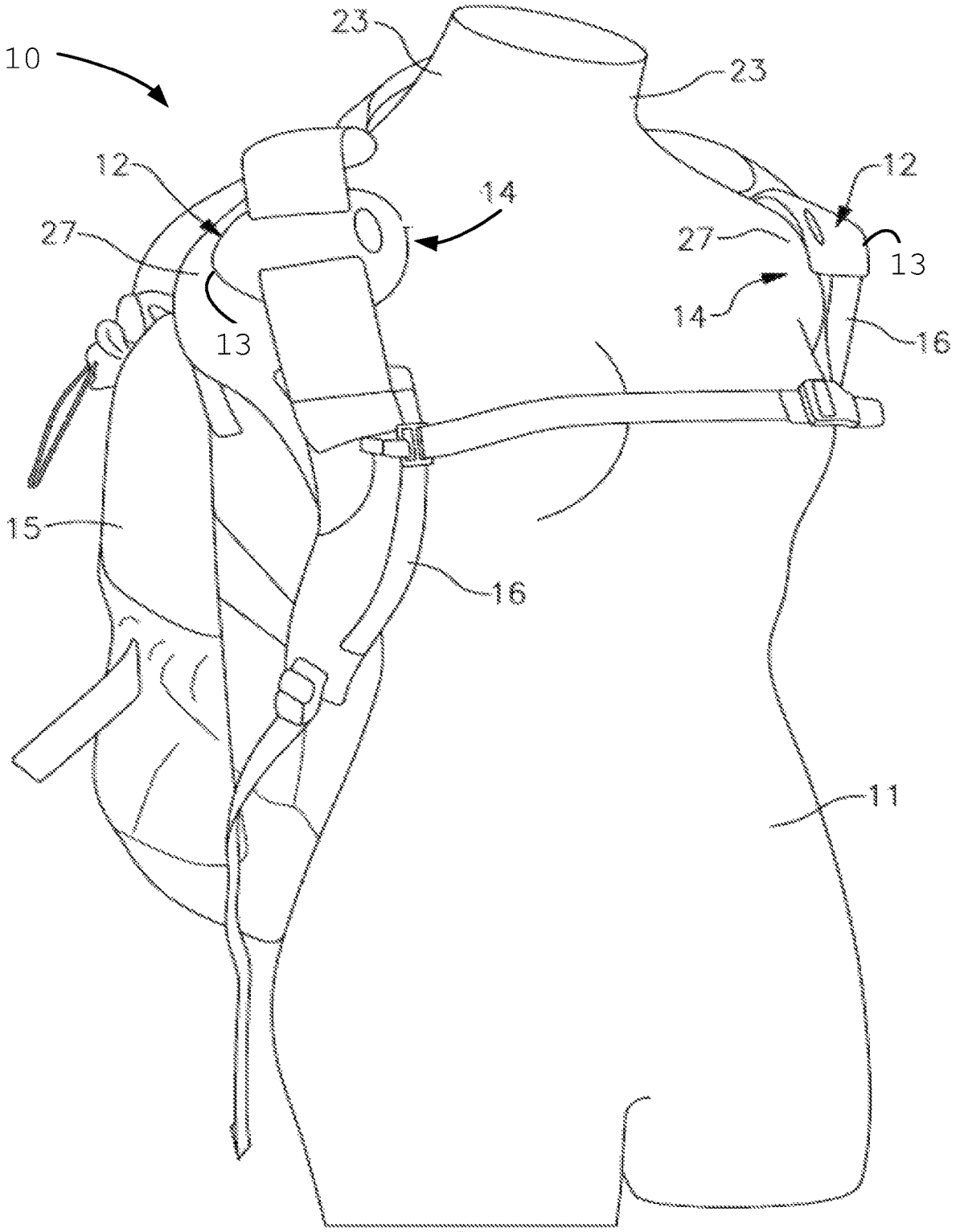
FIG. 14 is a front side-off-view illustration of the load bearing system of FIG. 13.
Figure 15:
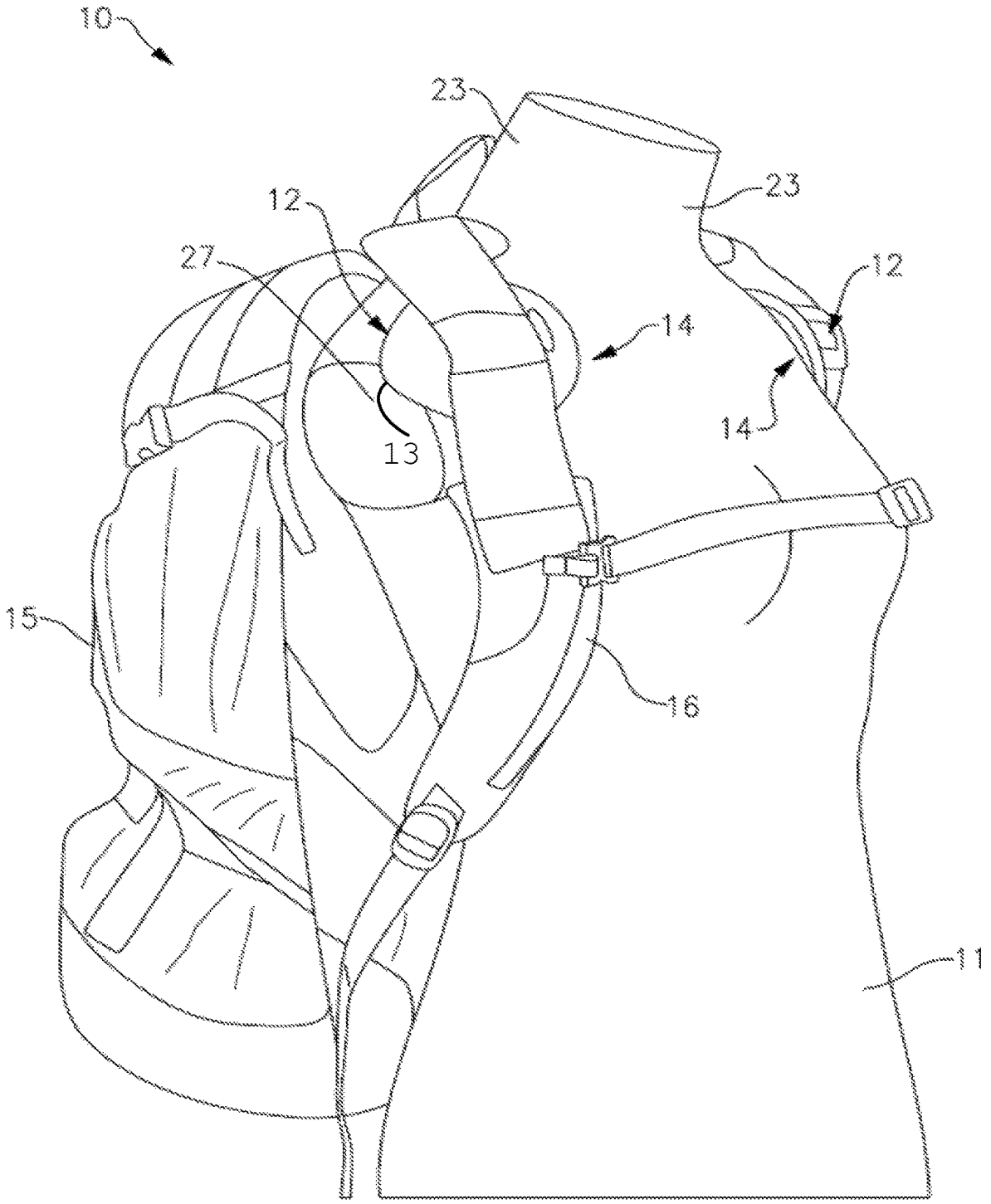
FIG. 15 is a side-view illustration of the load bearing system of FIG. 13.

With additional reference to FIGS. 13-15, in one embodiment, the system 10 includes an acromion-socket 12 constructed out of multiple components that are shaped to engage a user's acromion-portion 14. The system 10 also includes a strap 16 positioned away from the user's 11 neck 23 by the acromion-socket 12 to connect a load 15 to the user. For example, the neck 23 includes the user's 11 trapezius muscle. In another example, the neck 23 excludes the user's 11 trapezius muscle.

In one embodiment, the acromion-socket 12 is shaped to also engage a user's 11 upper humerus 18 that is closest to the user's acromion-portion 14, and the multiple components includes a weight bearing material and at least one of fabric, thread, adhesive, fastener, deformable material, hard member, thermoformed material, webbing, and flexible member. In another embodiment, the acromion-socket 12 is removable from the strap 16, can be added to the strap, can be positioned anywhere along the strap, positioned by strap tension, and/or integral to the strap.

In one embodiment, the load 15 is carried in front, back, and/or side of the user 11. In other words, the load 15 can be carried on the front, back, or side of the user 11. In another embodiment, the strap 16 crosses a vertical line 24 defined by the user's 11 spinal cord (not shown) and/or does not cross a vertical line defined by the user's spinal cord.

In one embodiment, the acromion-socket 12 shape is fixed prior to any load 15 bearing. In another embodiment, the acromion-socket 12 is pre-formed by a manufacturer (not shown) of the acromion-socket to aid in engaging the user's 11 acromion-portion 14, and the strap 16 is narrower than the acromion-socket to provide the user reduced heat buildup, increased mobility, reduced chances of snagging, and/or greater ease of use.

In one embodiment, the acromion-socket 12 pre-forming is achieved by material cut pattern, fastening pattern, fabrication process, panel shaping, thermo-forming, and/or material selection. In another embodiment, the acromion-socket 12 maintains the load's 11 weight on the user's acromion-portion 14 during use of the acromion-socket by positioning the acromion-socket on the user's acromion-portion through the cupping of the user's acromion-portion instead of permitting the acromion-socket to slide away from the user's acromion-portion and towards the user's neck 23.

In one embodiment, the acromion-socket 12 transfers a majority of the load's weight to the user's 11 acromion-portion 14. In another embodiment, the user's 11 acromion-portion 14 includes a portion of the user's deltoid muscle 27.

In another embodiment, the system 10 includes an acromion-socket 12 that is shaped to engage a user's 11 acromion-portion 14, the acromion-socket is designed to carry a load 15 greater than five pounds for over an hour without damaging the acromion-socket, and/or the acromion-socket positions a load away from the user's neck 23. For example, the acromion-socket 12 is constructed for repeated heavy load 15 carrying for extended periods of time without damage to the acromion-socket. In another embodiment, the acromion-socket 12 is designed to carry a load 15 of two hundred pounds for fifteen years without damaging the acromion-socket.

In an alternative embodiment, the system 10 includes an acromion-socket 12 to receive a user's 11 acromion-portion 14 where the acromion-socket's greatest width while being used is larger than the strap's greatest width while being used, and the acromion-socket is pre-formed to aid in receiving the user's acromion-portion. The system 10 also includes a strap 16 positioned by the acromion-socket 12 where the strap connects a load 15 to the user 11.

Historically, a load bearing strap transfers the weight onto the neck and clavicle of the user. However, system 10 positions the load away from the neck of the user.

As will be appreciated by one skilled in the art, aspects may be embodied as a system and/or method. The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the embodiments. The embodiment was chosen and described in order to best explain the principles of the embodiments and the practical application, and to enable others of ordinary skill in the art to understand the various embodiments with various modifications as are suited to the particular use contemplated.

While the preferred embodiment has been described, it will be understood that those skilled in the art, both now and in the future, may make various improvements and enhancements which fall within the scope of the claims which follow. These claims should be construed to maintain the proper protection for the embodiments first described.

Aspects of the embodiments are described above with reference to flowchart illustrations and/or block diagrams of methods and systems (apparatus) according to the embodiments. The flowchart and block diagrams in the Figures illustrate the architecture, functionality, and operation of possible implementations of systems and methods according to various embodiments. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the embodiments. The embodiment was chosen and described in order to best explain the principles of the embodiments and the practical application, and to enable others of ordinary skill in the art to understand the various embodiments with various modifications as are suited to the particular use contemplated.

While the preferred embodiment has been described, it will be understood that those skilled in the art, both now and in the future, may make various improvements and enhancements which fall within the scope of the claims which follow. These claims should be construed to maintain the proper protection for the embodiments first described.

What is claimed is:

1. A system comprising:

a pair of acromion-sockets, each of the acromion-sockets being formed of a hard member shaped to engage a respective one of a user's pair of acromions and including:

a first socket portion extending over a top of the respective one of the user's pair of acromions from a first socket end oriented toward a respective side of a neck of the user; and a second socket portion extending outwardly of a respective upper humerus of the user and downwardly from the first socket portion to a second socket end such that the first socket end is located above the second socket end;

a pair of straps, each strap attached under a respective one of the acromion-sockets and configured to loop under a respective one of the user's arms; and a load connected to the pair of straps wherein a front of the acromion-socket is L-shaped when viewed from the front of the user.

2. The system of claim 1 wherein the straps carry the load on the back of the user.

3. The system of claim 1 wherein neither of the straps crosses a vertical line defined by the user's spinal cord.

4. The system of claim 1 wherein a width of each strap extends at least partially under both the first and second socket portions of the respective acromion-socket to the front of the user.

* * * * *